United States Patent [19]

Barditch et al.

[11] Patent Number: 5,050,501

[45] Date of Patent: Sep. 24, 1991

[54] PROJECTED GRENADE SIMULATOR

[75] Inventors: Irving F. Barditch, Baltimore; Paul G. Schabdach, Churchville, both of Md.

[73] Assignee: The United States of America as represented by the Secretary of the Army, Washington, D.C.

[21] Appl. No.: 637,911

[22] Filed: Jan. 7, 1991

[51] Int. Cl.[5] ..... F42B 35/00

[52] U.S. Cl. ..... 102/293

[58] Field of Search ..... 102/293, 498; 73/167

[56] References Cited

U.S. PATENT DOCUMENTS 4,776,277 10/1988 Fiedler et al. ..... 102/293

*Primary Examiner*—Charles T. Jordan

*Attorney, Agent, or Firm*—Anthony T. Lane; Edward Goldberg; Michael C. Sachs

[57] ABSTRACT

A projected grenade simulator test circuit is used for checking the operability of a grenade launcher system by exactly duplicating both the physical and electrical characteristics of an actual grenade.

7 Claims, 1 Drawing Sheet

PROJECTED GRENADE SIMULATOR

GOVERNMENTAL INTEREST

The invention described herein may be manufactured, used and licensed by or for the Government for Governmental purposes without the payment to us of any royalty thereon.

BACKGROUND OF THE INVENTION

The military has fielded armored vehicles that have incorporated multiple grenade launching systems to protect the personnel inside from enemy threats. The problem with these vehicles has been the inability of the crew to easily and quickly check the operability of the grenade launching system. There has never been a grenade simulator available that exactly duplicates the physical and electrical characteristics of the actual grenade used.

In the past a grenade was fired by the launcher by applying a sufficient voltage to the grenades terminals to produce approximately one ampere of current. This current flows through an internal electrical match to electrical ground. The match then ignites, which in turn ignites the charge in the grenade. Once this match has ignited, the electrical connection to ground is broken.

The characteristics of an actual grenade are that it shows between 1 and 1½ ohms of resistance to ground across its terminals before firing and an open circuit to ground after firing. This action takes place in approximately 3 milliseconds.

The prior art test unit was nothing more than an empty grenade case with an indicator lamp which lighted during grenade launcher tests, and two jacks for checking circuit continuity connected in parallel across the lamp.

This test set was unsatisfactory for testing the grenade launching system because it required two people to operate the system and it did not present the required 1 to 1½ ohms to ground as the actual electrical match required. In addition, the prior art test equipment did not open the circuit to ground once it was used.

Other test simulators tried substituting a 1 ampere fuse across the test electrical terminals. This was not suitable because the 1 ampere would not blow due to the characteristics of the firing circuit, necessitating the use of a ¼ ampere fuse. This was not satisfactory because the ¼ ampere fuse shows 2.3 ohms to ground instead of the required 1 ohm. In addition, it is difficult to detect whether the fuze was good to start with and hard to detect when it was blown. A further detriment to the use of a fuze was that an ohm meter was required to check continuity because of the visual problem. Another problem with the ¼ ampere fuze was that it could only be used once and that gave the wrong current draw to the system and did not represent the current draw of an actual electric match. Since the system would not work if a fuze was not available, large supply of fuses must be maintained on hand.

The attempt to use a circuit breaker in place of a fuze was not feasible because a circuit breaker in this current range requires too long a pulse to operate and would be of the wrong resistance reading.

Other prior art test simulators utilizing an indicator meter were unsatisfactory because they did not meet the 1 to 1½ ohm resistance requirement prior to testing, failed to open the circuit to electrical ground, required two people to operate and made it extremely difficult to monitor more than one launch tube at a time since the meter must be continually watched to observe its movement indicating a fire pulse has been present.

SUMMARY OF THE INVENTION

The present invention relates to a projected smoke screening grenade simulator for checking operability of multiple launchers used in armored vehicle defense systems.

An object of the present invention is to provide a grenade simulator which simulates the electrical characteristics of an actual smoke grenade prior to firing.

Another object of the present invention is to provide a grenade simulator which is safe to use.

Another object of the present invention is to provide a grenade simulator which exactly duplicates both the physical and electrical characteristics of a fielded smoke screening grenade.

Another object of the present invention is to provide a grenade simulator whose electrical impedance is one ohm before test, and open circuit to ground after test.

Another object of the present invention is to provide a grenade simulator which is relatively inexpensive to use.

Another object of the present invention is to provide a grenade simulator which is resettable and self checking.

Another object of the present invention is to provide a grenade simulator which permits one man operation.

A further object of the present invention is to provide a grenade simulator which has very low maintenance, has long life, is very rugged, is weather resistant and requires no calibration.

For a better understanding of the present invention, together with other and further objects thereof, reference is made to the following descriptions taken in connection with the accompanying drawings.

BRIEF DESCRIPTION OF THE DRAWINGS

Throughout the following description, like reference numerals are used to denote like parts of the drawings.

DETAILED DESCRIPTION OF THE PREFERRED EMBODIMENTS

Figure 1:
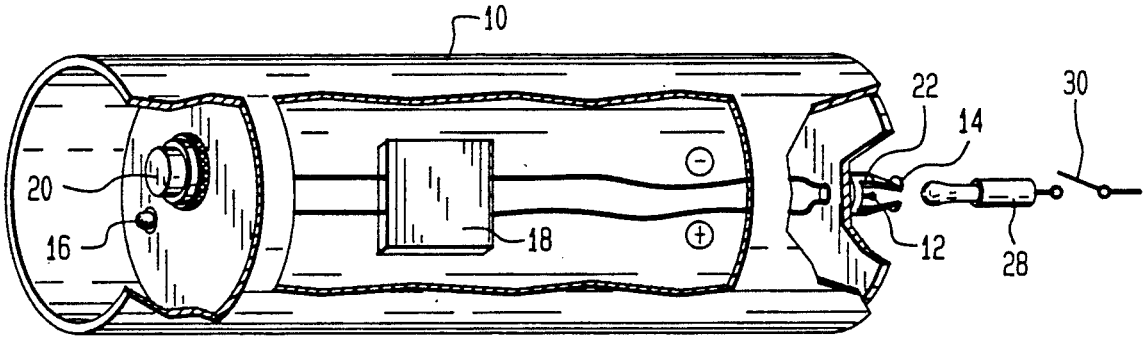
FIG. 1 is a partial cut away isometric view of the projected grenade simulator.
Figure 2:
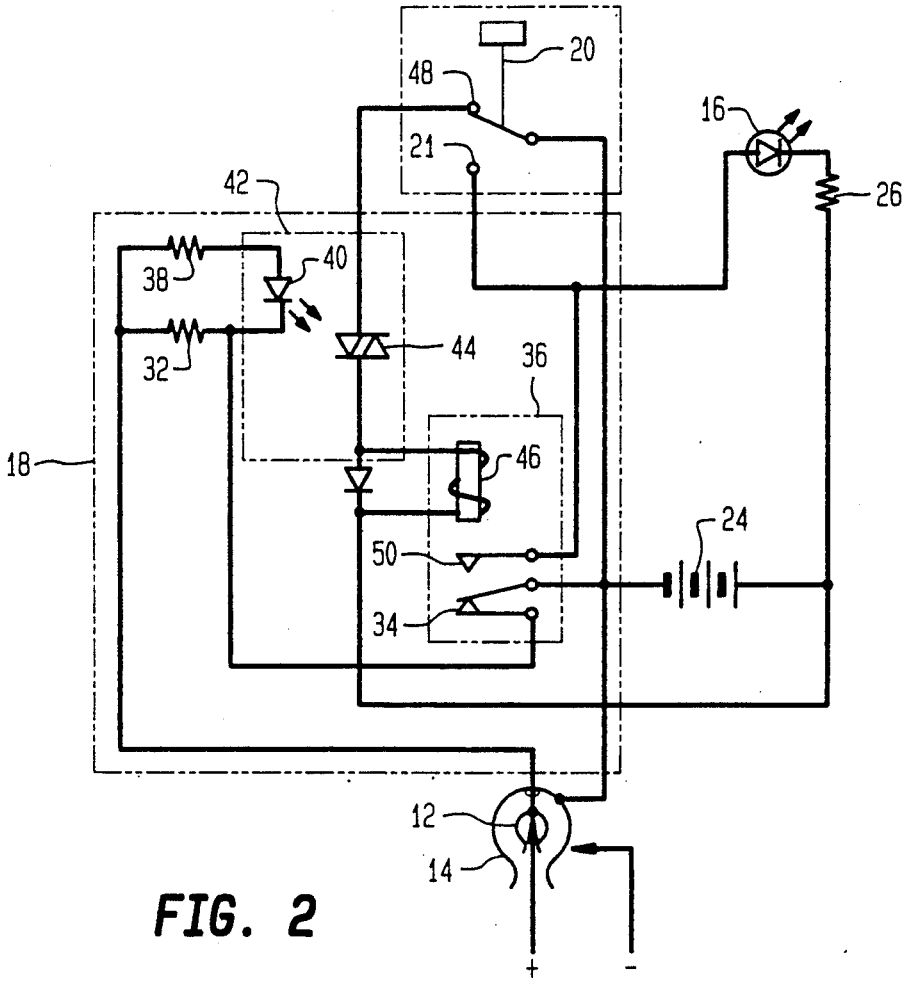
FIG. 2 is a diagramatic view of the electical circuit contained within the grenade simulator.

Referring now to FIG. 1, the simulator 10 exactly duplicates both the external physical and internal electrical characteristics of a fielded smoke screening grenade. The resistance, across the female jack terminals 12 and 14, is one ohm before firing and open circuit to ground after firing. This device has the advantage of being resettable, self checking and permits one man operation. Since a LED indicator light 16 remains lit until reset, it is possible for one person to test the entire 80 launch tube system by oneself in 1/80th of the time it would take two people to test the system by prior art methods. A circuit board 18 to be described hereinafter, when referring to FIG. 2, is electrically connected between a single pole double throw momentary pushbutton switch 20 and female jack 22. Other advantages of simulator 10 include very low maintenance, no tools required to change an internal 9 volt D.C. battery, long life LED light, no calibration, very rugged and weather resistance.

Referring now to FIGS. 1 and 2, in operation prior to testing the single pole double throw momentary pushbutton switch 20, located on top of the simulator 10, is operated. When the button 20 is pressed, the normally open contact 21 of the switch 20 closes thus connecting the ground side of the 9 volt battery 24 to the cathode side of the light emitting diode (LED) 16, completing the circuit to the LED 16 through a current limiting resistor 26 of 360 ohms. The lighting of LED 16 indicates that there is sufficient charge in the battery 24 to operate the system. The operator may then activate the launcher system and send a fire signal to the desired launch tubes by inserting male plug 28 and closing normally open switch 30. In the simulation test the fire signal enters grenade simulator 10 through the female plug contacts 12 and 14 and sees a 1.2 ohm input calibration resistor 32 to ground through the normally closed contacts 34 of the relay 36. The fire signal also goes through a 220 ohm current limiting resistor 38 which is in series with a gallium-arsenide infrared emitting diode 40. Resistor 38 and infrared diode 40 are connected in parallel across the calibration resistor 32. Fire signal voltage developed across the infrared diode 40 causes the infrared diode 40 in the optocoupler triac driver chip 42 (Model Number MOC3010) to operate. Diode 40 in turn triggers the isolated triac 44 which is also in the MOC3010 integrated circuit chip 42. Once triggered, the triac 44 operates and locks up completing a circuit from the positive side of battery 24 through the coil 46 of the relay 36, through the locked up triac 44, through the normally closed contact 48 of pushbutton 20 to the electrical ground 14 of female jack 22. The completion of the aforementioned circuit energizes coil 46 of the relay 36. Element 51 is a relay protection diode for relay 36. Once relay 36 operates, the normally closed contacts 34 open up which opens the path to ground for the incoming fire signal. This contact 34 opens in approximately 3 milliseconds, or the same amount of time required to open the launch tube circuit which utilizes a grenade having an electric match. The normally open contacts 50 of the relay 36 close which grounds the minus side of the LED 16. As long as there is a complete circuit, the triac 44 in the MOC3010 chip 42 stays operative which in turn keeps the relay 36 operating. The system will stay in this configuration until it is reset by pressing the pushbutton switch 20. Upon operating the switch 20, the normally closed contacts 48 are opened. This breaks the circuit to ground through the triac 44 causing the coil 46 of the relay 36 to release. The circuit is now waiting for the next fire pulse.

The aforementioned circuit system exactly duplicates the physical and electrical characteristics of an actual grenade.

While specific embodiments of the invention have been shown and described in detail to illustrate the principles of the invention, it will be understood that the invention may be embodied otherwise without departing from such principles.

What is claimed is:

1. A projected grenade simulator test circuit which comprises:

diode means for indicating sufficiency of battery charge to operate said simulator circuit;

direct current power means for supply voltage to said test circuit; momentary pushbutton switch means for momentarily electrically coupling said power means to said diode means;

female jack means electrically coupled to said test circuit for receiving a test fire signal;

relay means for applying said test fire signal to said simulator test circuit;

input resistance means electrically coupled to said fire signal by said relay means for simulating a 1.2 ohm resistance of an actual grenade before firing; and optocoupler triac driver means electrically coupled through said relay means to said fire signal and through said pushbutton means to said power means for opening a path to ground for said incoming fire signal in approximately 3 millionseconds, thereby simulating the time required to open the circuit by an electric match of an actual grenade and for presenting an open circuit to ground before firing.

2. A projected grenade simulator test circuit as recited in claim 1 wherein diode means includes:

a light emitting diode operatively electrically coupled to said power means through said pushbutton means; and a first current limiting resistor in series with a positive terminal of said power means.

3. A projected grenade simulator test circuit as recited in claim 2 wherein said power means includes a 9 volt direct current battery.

4. A projected grenade simulator test circuit as recited in claim 3 wherein said momentary pushbutton means includes a single pole double throw momentary pushbutton having a normally closed contact electrically connected to said triac driver means and to the negative terminal of said battery; and a normally open contact terminal electrically connected to a cathode terminal of said light emitting diode and to a normally open contact of said relay means.

5. A projected grenade test circuit as recited in claim 4 wherein said optocoupler triac driver means includes:

a gallium-arsenide infrared diode having a cathode electrically coupled to the negative side of said battery through normally closed contacts of said relay means and to one side of said input resistance, and an anode electrically coupled to the positive terminal of said female jack means and the other side of said input resistance; and a second current limiting resistance electrically coupled in series with said anode terminal of said infrared diode and the positive terminal of said female jack means.

6. A projected grenade test circuit as recited in claim 5 wherein the triac driver means further includes an isolated triac member in operable proximity to said gallium-arsinide infrared diode in series with a normally closed contact of said momentary pushbutton means and said relay means.

7. A projected grenade test circuit as recited in claim 6 wherein the relay means further includes:

a relay coil electrically coupled in series with said isolated triac and the positive side of said battery; and a normally closed relay switch in operable proximity to said relay coil, upon operation of said pushbutton, said relay switch breaking the circuit to ground through said isolated triac causing said relay coil to release and thereby reseting said simulator test circuit for the next fire pulse.

* * * * *